United States Patent [19]

Stramaglia

[11] 4,055,293

[45] Oct. 25, 1977

[54] TRAY WITH REINFORCED WALLS

[75] Inventor: Melchiore M. Stramaglia, Castro Valley, Calif.

[73] Assignee: Container Corporation of America, Chicago, Ill.

[21] Appl. No.: 765,761

[22] Filed: Feb. 4, 1977

[51] Int. Cl.[2] ..... B65D 5/22; B65D 5/24

[52] U.S. Cl. ..... 229/31 FS

[58] Field of Search ..... 229/31, 31 FS, 34 HW

[56] References Cited

U.S. PATENT DOCUMENTS

| | | | |
|---|---|---|---|
| 1,778,462 | 10/1930 | Nourse et al. | 229/31 FS X |
| 2,702,663 | 2/1955 | Klein | 229/31 FS |
| 2,768,776 | 10/1956 | Weiss | 229/31 FS |
| 2,942,769 | 6/1960 | Kuchenbecker | 229/31 FS |
| 3,049,280 | 8/1962 | Frankenstein | 229/31 FS |
| 3,533,547 | 10/1970 | Houston | 229/31 FS X |

FOREIGN PATENT DOCUMENTS

| | | | |
|---|---|---|---|
| 1,501,929 | 9/1967 | France | 229/31 FS |

*Primary Examiner*—Davis T. Moorhead
*Attorney, Agent, or Firm*—Carpenter & Ostis

[57] ABSTRACT

An open top tray formed of foldable paperboard and including a bottom wall and opposed pairs of vertical walls upstanding therefrom and joined at the corners of the tray wherein certain of the vertical walls include an outer panel, an inner panel, and an intermediate reinforcing panel, adapted to minimize bowing of said walls.

2 Claims, 4 Drawing Figures

TRAY WITH REINFORCED WALLS

SUMMARY OF THE INVENTION

This invention relates to tray type cartons of the type commonly used by retail stores for the packaging of various articles. Cartons of this type are generally formed of a relatively thin paperboard such as folding carton stock, and include multi-ply side and end walls joined to and upstanding from a bottom wall and foldably joined to each other at the corners of the carton.

It is common in trays of this type to have side walls with inner and outer panels glued together in face-to-face relation, and with end walls connected to the side walls at the corners of the tray by gusset members, and which include full depth inner and outer panels which are folded into face-to-face relation with the gusset members sandwiched therebetween. The inner panels are generally also provided with a lock flap or foot which is secured to the bottom wall of the tray by some type of mechanical lock. Thus the carton side walls are glued and the carton end walls are not glued so the carton can be shipped to the user in a flattened condition and then can be erected by merely folding up the side walls and folding the end walls into position and locking them with the side walls and bottom wall.

It is the purpose of this invention to provide, in a tray of this general type, a construction arrangement which utilizes substantially less paperboard by providing less than full height on the inner end wall panels. This would normally present a problem because the inner panel which is not glued in position, as the inner panels of the side walls are, would normally tend to bow inwardly. In the present invention there is provided a relatively narrow third or intermediate reinforcing panel which is folded between the inner and outer panels to provide a resistance to bowing of the inner panel.

These and other objects of the invention will be understood from an examination of the following description and drawings:

THE DRAWINGS

Figure 4:
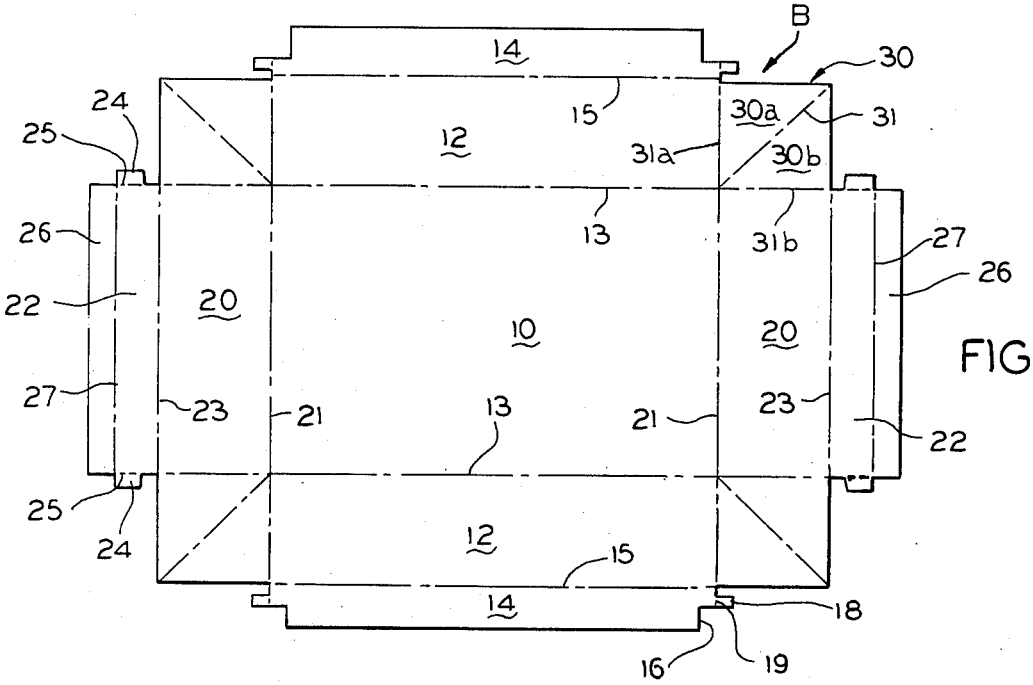
FIG. 4 is a top plan view of the inside surface of a blank paperboard from which the carton illustrated in the other views may be formed.
Figure 3:
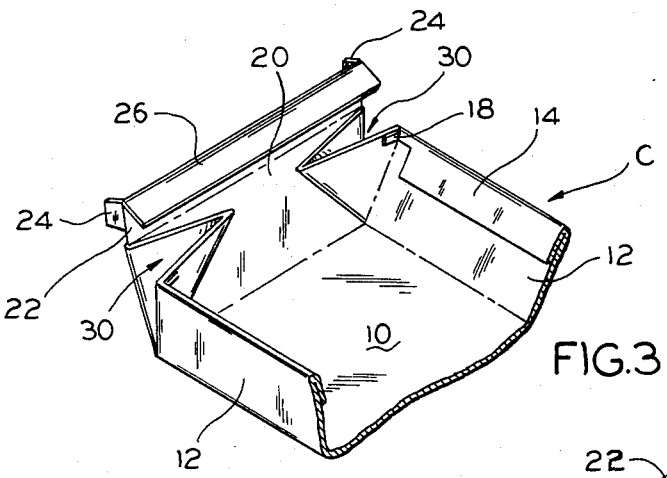
FIG. 3 is a perspective view of the structure illustrated in FIG. 1 but shown in a partially erected condition to illustrate the manner in which the end wall is formed.
Figure 1:
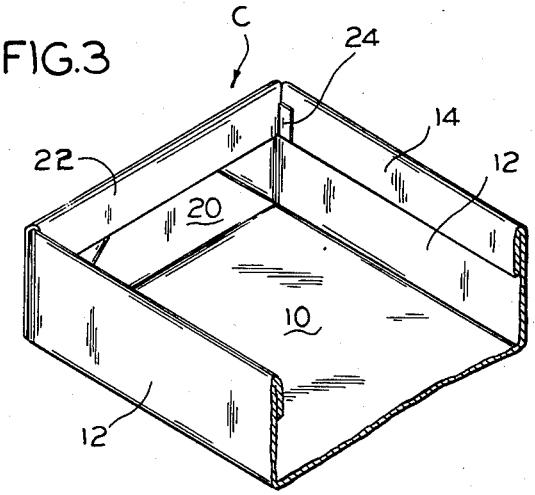
FIG. 1 is a fragmentary, perspective view of an open top, tray top paperboard carton embodying features of the invention, with the carton shown in a fully erected condition.
Figure 2:
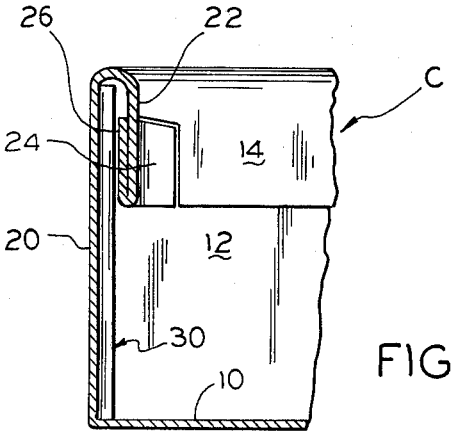
FIG. 2 is a longitudinal, vertical cross section of the end wall of the structure illustrated in FIG. 1.

Referring now to the drawing for a better understanding of the invention, it will be seen that the carton indicated generally at C in FIGS. 1 and 3 is an open top, tray type carton of the type used in retail store packaging and which may be formed from the unitary blank of paperboard indicated generally at B in FIG. 4.

As best shown in FIGS. 1 and 4, it will be seen that the carton includes a preferably rectangular bottom wall 10 having opposed pairs of side and end walls secured thereto and upstanding therefrom.

Each of the side walls includes an outer panel 12 foldably joined to related side edge of bottom wall 10 along a fold line 13 and an inner panel 14 foldably joined at one edge along fold line 15 to the upper edge of outer panel 12. Inner panel 14 is folded inwardly and downwardly 180° so as to lie and preferably be secured by adhesive, not shown, to the inner face of outer panel 12. Each side wall inner panel 14 is provided at opposite ends thereof with a cutout or locking recess 16 adapted to receive complementary locking tab of an adjacent end wall in a manner hereinafter described. Also, each of the side wall inner panels 14 may be provided at opposite ends thereto with a small reinforcing tab 18 foldably joined thereto on fold line 19. The purpose of this tab is described later in the specification.

Each of the end walls of the carton includes an outer panel 20 foldably joined along fold line 21 to a related end edge of bottom wall 10 and an inner panel 22 foldably joined along one edge along a fold line 23 to the upper edge of outer panel 20.

Each of the end wall inner panels 22 is provided at opposite ends with a small locking tab 24 foldably joined thereto on a fold line 25. The purpose of the lock tabs 24 is to be received within the locking recesses 16 of the adjacent side wall inner panels when the carton is in the erected condition, as shown in FIG. 1, with the end wall inner panels 22 being folded over to lie adjacent and parallel to the inner faces of outer panels 20.

In order to prevent bowing of the end walls and particularly the inward bowing of the end wall inner panels which are not adhesively secured as in the case of the side wall inner panels, there is provided a relatively narrow intermediate reinforcing panel 26 which is foldably joined along fold line 27 to the lower edge of end wall inner panel 22.

In order to connect the side walls to the end walls, there may be provided at each corner of the carton, a gusset member 30 which comprises a pair of generally triangular first and second panels, **30*a* and 30*b*. The gusset panels 30*a* and 30*b* are foldably joined to each other along a diagonal fold line 31 and are also joined to adjacent edges of related side and end wall inner panels 12 and 20 along fold lines 31*a* and 31*b***, respectively.

Thus when the carton is in the erected condition with the side wall inner panels 14 adhesively secured to the inner faces of side wall outer panels 12, with the panels of each gusset member folded in face-to-face relation and lying against the inner surfaces of the related end wall outer panels, the end wall inner panels are folded downwardly and the reinforcing panels are folded back upwardly so as to lie between the gusset members and the inner panels with the corner locks in place and with the reinforcing tabs 18 folded 90° and inserted between the inner and outer panels of related end walls.

Thus it will be seen that the invention provides an open top tray type carton which utilizes substantially less paperboard than a carton having full depth double ply end walls and locking feet, and that this inexpensive construction is accomplished by the novel bow resistant reinforcing flaps 26 provided in the end walls.

I claim:

1. In a tray type folding carton formed from a unitary blank of foldable sheet material such as paperboard, the combination of:

a. a bottom wall having opposed pairs of side and end walls foldably joined to and upstanding from opposed side and end edges thereof, and foldably joined to each other to form a box-like structure open at the top;

b. gusset means at each corner of said carton, each including a pair of generally triangular gusset panels foldably joined to each other and to respective end edges and side edges of adjacent side and end walls and folded into face-to-face engagement with inner surfaces of said end walls;

c. said side walls each including an outer panel foldably joined at its lower edge to a side edge of said bottom wall and an inner panel foldably joined at one edge to an upper edge of said outer panel and being folded inwardly and downwardly into face-to-face engagement with said outer panel;

c. said end walls each including:

i. an outer panel foldably joined at its lower edge to an end edge of said bottom wall;

ii. an inner panel of substantially less height than the height of said end wall outer panel, foldably joined at one edge to an upper edge of said end wall outer panel and folded inwardly and downwardly to overlie an upper marginal portion of said end wall outer panel;

iii. an intermediate panel foldably joined at one edge to a lower edge of said end wall inner panel and folded outwardly and upwardly to lie between said end wall outer and inner panels to provide reinforcement for said end wall and thereby minimize bowing thereof.

e. means forming an interlocking connection between adjacent side and end walls at the corners of said carton.

2. In a tray type folding carton formed from a unitary blank of foldable sheet material such as paperboard, the combination of:

a. a bottom wall having opposed pairs of side and end walls foldably joined to and upstanding from opposed side and end edges thereof, and foldably joined to each other to form a box-like structure open at the top;

b. said side walls each including an outer panel foldably joined at its lower edge to a side edge of said bottom wall and an inner panel foldably joined at one edge to an upper edge of said outer panel and being folded inwardly and downwardly into face-to-face engagement with said outer panel;

c. said end walls each including:

i. an outer panel foldably joined at its lower edge to an end edge of said bottom wall;

ii. an inner panel of substantially less height than the height of said end wall outer panel, foldably joined at one edge to an upper edge of said end wall outer panel and folded inwardly and downwardly to overlie an upper marginal portion of said end wall outer panel;

iii. an intermediate panel foldably joined at one edge to a lower edge of said end wall inner panel and folded outwardly and upwardly to lie between said end wall outer and inner panels to provide reinforcement for said end wall and thereby minimize bowing thereof.

* * * * *